US005522455A

United States Patent [19]

Brown et al.

[11] Patent Number: 5,522,455

[45] Date of Patent: Jun. 4, 1996

[54] HEAT PIPE MANIFOLD WITH SCREEN-LINED INSERT

[75] Inventors: Richard F. Brown, Hauppauge; Bruce Cordes, Rockville Centre; Fred Edelstein, Hauppauge; Robert L. Kosson, Massapequa, all of N.Y.

[73] Assignee: Northrop Grumman Corporation, Los Angeles, Calif.

[21] Appl. No.: 238,709

[22] Filed: May 5, 1994

[51] Int. Cl.[6] ..... F28D 15/00

[52] U.S. Cl. ..... 165/104.26; 165/104.21

[58] Field of Search ..... 165/104.26, 104.21; 361/700; 257/715, 714

[56] References Cited

U.S. PATENT DOCUMENTS

| | | | |
|---|---|---|---|
| 3,971,435 | 7/1976 | Peck | 257/715 |
| 4,003,427 | 1/1977 | Leinoff et al. | 165/104.26 |
| 4,274,479 | 6/1981 | Eastman | 165/104.26 |
| 4,523,636 | 6/1985 | Meijer et al. | 165/104.26 |
| 4,703,796 | 11/1987 | Meijer et al. | 165/104.26 |
| 4,785,875 | 11/1988 | Meijer et al. | 165/104.26 X |

FOREIGN PATENT DOCUMENTS

| | | |
|---|---|---|
| 5335126 | 4/1978 | Japan . |

*Primary Examiner*—John Rivell
*Assistant Examiner*—Christopher Atkinson
*Attorney, Agent, or Firm*—Terry J. Anderson; Karl J. Hoch, Jr.

[57] ABSTRACT

A monogroove heat pipe has a single central manifold communicating with plural parallel connected evaporators and a single condenser. The invention is directed to a tubular screen device which is axially positioned within the liquid channel of the manifold. A number of longitudinally spaced holes are formed in the body of the screen device, each hole being defined by cusp edges which are turned outwardly from the screen body into joint ends of the condenser and evaporator liquid channels. The existence of the screen material at the joint between condenser, evaporators, and the manifold assists the establishment of a primed condition in the heat pipe, even in a zero "g" environment for any initial liquid distribution within the heat pipe.

5 Claims, 1 Drawing Sheet

HEAT PIPE MANIFOLD WITH SCREEN-LINED INSERT

FIELD OF THE INVENTION

The present invention relates to monogroove heat pipes, and more particularly to a manifold design therefor.

BACKGROUND OF THE INVENTION

Monogroove heat pipes are used extensively in spacecraft for "dumping" excessive heat from electronic circuits, etc., to cold ambient outer space. Such heat pipes offer significant advantages as a heat-exchanging medium due to the fact that they lack mechanical components and therefore their reliability is inherently high. As a result, heat pipes have been manufactured in longer and longer lengths to accomplish greater heat transfer rates. An inherent problem in the utilization of such heat pipes on board space vehicles is the inability to establish a primed condition in the liquid channel in a zero "g" environment independent of the initial liquid distribution in the heat pipe.

In a prior art development of the present assignee, a monogroove heat pipe was constructed to include a single condenser and multiple evaporators, all communicating with a central manifold. However, the connection of the condenser and evaporators to the manifold generally involves right-angle joints, which cause surface discontinuities in the liquid-vapor path through the heat pipe thereby inhibiting the establishment of a primed condition.

BRIEF DESCRIPTION OF THE PRESENT INVENTION

The present invention relates to an improvement over the previously mentioned prior art heat pipe of the present assignee. It is more particularly directed to an improved manifold for the heat pipe wherein a tubular screen is inserted along the length of the manifold and cusp slits formed in the screen are turned up into the ends of the condenser and the multiple evaporators (communicating with the manifold).

The interpositioning of the tubular screen device modifies the sharp discontinuities at the joints of the manifold joining the condenser and evaporator sections and in general promulgate the establishment of a primed condition for the heat pipe in a zero "g" environment independent of the initial liquid distribution.

BRIEF DESCRIPTION OF THE FIGURES

The above-mentioned objects and advantages of the present invention will be more dearly understood when considered in conjunction with the accompanying drawings, in which.

DETAILED DESCRIPTION OF THE INVENTION

Figure 1:
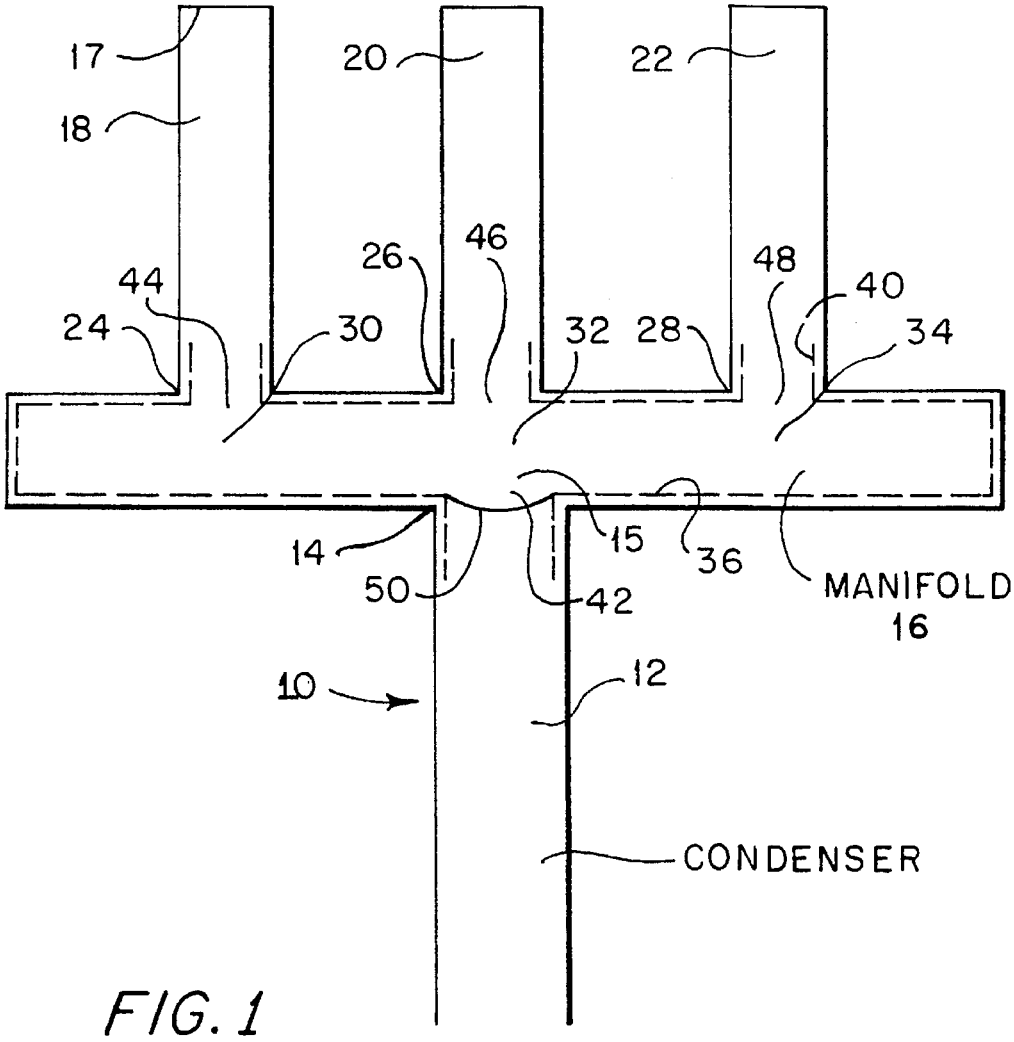
FIG. 1 is a diagrammatic view of the liquid channel of a monogroove heat pipe equipped with a screen device in accordance with the present invention.

Referring to FIG. 1, the heat pipe equipped with the tubular screen device of the present invention is generally indicated by reference numeral 10. The monogroove heat pipe includes a single condenser 12 having a fixed end (joint) 14 in fluid communication with the intermediately disposed manifold 16 and forms a joint 15. The manifold 16 is substantially perpendicular to the condenser 12.

On a side opposite the joint 15 of manifold 16 are a plurality of evaporators 18, 20, and 22 which communicate in parallel fashion with the central manifold 16. Each of the evaporators has an outward end 17 and fixed ends 24, 26, and 28 which communicate directly with manifold 16 and form respective joints 30, 32, and 34. The manifold 16 is also substantially perpendicular to the evaporators 18, 20, and 22. Thus far described, the monogroove heat pipe represents prior art.

Figure 2:
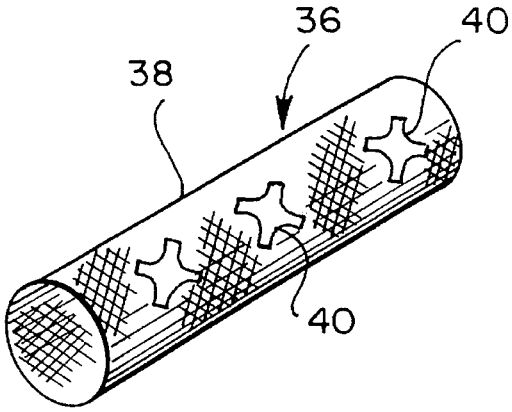
FIG. 2 is a schematic perspective illustration of the screen device as employed in the present invention.

The tubular screen device constituting the present invention is more particularly schematically illustrated in FIG. 2 where it is seen that the tubular screen device is generally indicated by reference numeral 36 and consists of a screen body 38 which is rolled into a tubular shape. Longitudinally along the length of the screen device 36 are slitted sections 40 which form openings that become respectively aligned with the evaporator and condenser joints after the screen device 36 is positioned within the manifold 16 as shown in FIG. 1. The edges of these openings are cusp shaped and are deformed outwardly from the main body of the screen device into the joints 30, 32, 34, and 15 so as to form correspondingly positioned screen device holes 44, 46, 48, and 42.

In operation of the device, a meniscus 50 will form inwardly from the manifold into the condenser through the screen device hole 42. The existence of the tubular screen device in manifold 16 as well as the screen material extensions into the condenser 12 and evaporators 18, 20, and 22 provides a fine pore capillary flow path which draws liquid around the sharp discontinuity in the joints joining the condenser and evaporators so that the liquid channel may achieve a primed condition, even in a zero "g" environment such as space and regardless of the initial liquid distribution.

Although the present invention has been described in terms of a single condenser for cooperation with parallel oriented evaporators, it should be understood that a plurality of condensers may be connected and communicating with the manifold 16.

It should be understood that the invention is not limited to the exact details of construction shown and described herein for obvious modifications will occur to persons skilled in the art.

We claim:

1. In a monogroove heat pipe having a condenser, evaporators, and a manifold intermediately connected therebetween, the improvement comprising:

a tubular screen of mesh material axially positioned in the manifold; and openings, larger than mesh openings of the screen mesh itself, formed in the tubular screen and in alignment with respective passageways existing between the manifold and all of the evaporators and the condenser, the formed openings having upstanding tabular edges for forming a screen lining extension into each passageway.

2. In a heat pipe as set forth in claim 1 wherein the tabular edges have cusp outlines.

3. A monogroove heat pipe comprising:

a condenser section;

a plurality of evaporator sections;

a single manifold section intermediately positioned between the condenser section and the evaporator sections for providing working fluid interchange therebetween;

a rolled screen tube of mesh material received within a liquid channel of the manifold;

openings, larger than mesh openings of the screen mesh itself, formed in the tube and in alignment with respective passageways existing between the manifold and all of the evaporators and the condenser, the formed openings having upstanding tabular edges for forming a screen lining partially extending from the manifold liquid channel section into each liquid passageway of the condenser and evaporator sections.

4. In a heat pipe as set forth in claim 3 wherein the tabular edges have cusp outlines.

5. The heat pipe set forth in claim 4 wherein each formed opening having tabular edges includes four symmetrically positioned cusp edges.

* * * * *